US010569584B2

(12) United States Patent
Nakai et al.

(10) Patent No.: US 10,569,584 B2
(45) Date of Patent: Feb. 25, 2020

(54) TAPE CASSETTE

(71) Applicant: BROTHER KOGYO KABUSHIKI KAISHA, Nagoya-shi, Aichi-ken (JP)

(72) Inventors: Shimako Nakai, Nagoya (JP); Khairul Fatasha Mohd, Nagoya (JP); Tsutomu Kato, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/717,148

(22) Filed: Sep. 27, 2017

(65) Prior Publication Data

US 2018/0015757 A1 Jan. 18, 2018

Related U.S. Application Data

(63) Continuation of application No. PCT/JP2016/057529, filed on Mar. 10, 2016.

(30) Foreign Application Priority Data

Mar. 31, 2015 (JP) ..... 2015-073983

(51) Int. Cl.
*B41J 32/00* (2006.01)
*B41J 3/407* (2006.01)
(Continued)

(52) U.S. Cl.
CPC ..... *B41J 32/00* (2013.01); *B41J 2/325* (2013.01); *B41J 3/4075* (2013.01); *B41J 15/044* (2013.01);
(Continued)

(58) Field of Classification Search
CPC ..... B41J 32/00; B41J 3/4075; B41J 15/044; B41J 2/325; B41J 31/05; B41J 17/30; B41J 17/32
See application file for complete search history.

(56) References Cited

U.S. PATENT DOCUMENTS

2002/0012558 A1 1/2002 Huss et al.
2010/0166475 A1 7/2010 Yamaguchi et al.
(Continued)

FOREIGN PATENT DOCUMENTS

CN 101323217 A 12/2008
CN 101850663 A 10/2010
(Continued)

OTHER PUBLICATIONS

Machine translation of JP 2000-094773 A (JP 2000-094773 A was published on Apr. 4, 2000.) (Year: 2000).*
(Continued)

*Primary Examiner* — Justin Seo
(74) *Attorney, Agent, or Firm* — Scully, Scott, Murphy & Presser, P.C.

(57) ABSTRACT

A tape roll is housed inside a cassette case. A first rotation body is provided on a first direction side of the tape roll and is positioned on a second direction side of a winding center of the tape roll. A first opening is provided on the second direction side of the first rotation body. An ink ribbon roll is provided on the second direction side of the first opening. A second rotation body is provided on the first direction side and the second direction side of a winding center of the ink ribbon roll. A first regulating part is provided on a fourth direction side of a predetermined path and is positioned on the fourth direction side of a first virtual line.

14 Claims, 11 Drawing Sheets

(51) Int. Cl.

| | |
|---|---|
| ***B41J 15/04*** | (2006.01) |
| ***B41J 17/30*** | (2006.01) |
| ***B41J 17/32*** | (2006.01) |
| ***B41J 2/325*** | (2006.01) |
| ***B41J 31/05*** | (2006.01) |

(52) U.S. Cl.
CPC ..... *B41J 17/30* (2013.01); *B41J 17/32* (2013.01); *B41J 31/05* (2013.01)

(56) References Cited

U.S. PATENT DOCUMENTS

| | | | | |
|---|---|---|---|---|
| 2010/0166477 | A1 | 7/2010 | Yamaguchi et al. | |
| 2010/0166478 | A1 | 7/2010 | Yamaguchi et al. | |
| 2010/0166479 | A1 | 7/2010 | Yamaguchi et al. | |
| 2010/0166480 | A1 | 7/2010 | Yamaguchi et al. | |
| 2010/0247205 | A1 | 9/2010 | Yamaguchi et al. | |
| 2010/0247206 | A1 | 9/2010 | Yamaguchi et al. | |
| 2010/0247207 | A1 | 9/2010 | Sago et al. | |
| 2010/0247208 | A1 | 9/2010 | Yamaguchi et al. | |
| 2010/0247209 | A1 | 9/2010 | Yamaguchi et al. | |
| 2010/0247210 | A1 | 9/2010 | Yamaguchi et al. | |
| 2010/0247212 | A1 | 9/2010 | Yamaguchi et al. | |
| 2010/0254742 | A1 | 10/2010 | Yamaguchi et al. | |
| 2011/0008090 | A1 | 1/2011 | Yamaguchi et al. | |
| 2012/0008999 | A1 | 1/2012 | Yamaguchi et al. | |
| 2012/0080550 | A1 | 4/2012 | Yamaguchi et al. | |
| 2012/0175454 | A1 | 7/2012 | Noda | |
| 2015/0306892 | A1 | 10/2015 | Noda | |
| 2018/0015749 | A1* | 1/2018 | Inoue ..... | B41J 3/36 |

FOREIGN PATENT DOCUMENTS

| | | | |
|---|---|---|---|
| CN | 102099196 | A | 6/2011 |
| CN | 102241204 | A | 11/2011 |
| CN | 102481794 | A | 5/2012 |
| CN | 103862894 | A | 6/2014 |
| CN | 104442042 | A | 3/2015 |
| JP | 2000-094773 | A | 4/2000 |
| JP | 2004-42468 | A | 2/2004 |
| JP | 2004-148719 | A | 5/2004 |
| JP | 2006264337 | A | 10/2006 |
| JP | 2010-179482 | A | 8/2010 |
| JP | 2010-234775 | A | 10/2010 |
| JP | 2011206910 | A | 10/2011 |
| WO | WO 2010/113780 | A1 | 10/2010 |

OTHER PUBLICATIONS

Notification of Reasons for Rejection dated Nov. 21, 2017 received from the Japanese Patent Office in related application JP 2015-073983 together with English language translation.

International Search Report dated May 31, 2016 issued in PCT/JP2016/057529.

International Preliminary Report on Patentability dated Oct. 3, 2017 issued in PCT/JP2016/057529.

Extended European search report dated Jan. 3, 2019 received in related application EP 16772168.7.

Chinese Official Action dated Sep. 5, 2018 received in application CN 201680017872.6 together with an English language translation.

* cited by examiner

TAPE CASSETTE

CROSS-REFERENCE TO RELATED APPLICATION

This application is a continuation application of International Application No. PCT/JP2016/057529, filed Mar. 10, 2016, which claims priority from Japanese Patent Application No. 2015-073983, filed on Mar. 31, 2015. The disclosure of the foregoing application is hereby incorporated by reference in its entirety.

BACKGROUND

The present disclosure relates to a tape cassette housing a tape.

A tape cassette housing a tape that is a print medium is known. For example, a tape cassette houses a tape that is the print medium in a rear left portion of the tape cassette. An opening, which opens in the vertical direction, is provided in a right portion of the tape cassette. To the rear side of the opening, the tape bends toward the front, and then bends toward the left at a front right portion of the tape cassette. The tape is discharged from a discharge opening of an arm portion. As the print medium, for example, there is a case in which a label tape is used, on which a half cut process has been performed.

SUMMARY

For example, in the case of the above-described label tape on which the half cut process has been performed, there are cuts on the print surface side of the tape. Thus, there is a possibility that adhesive may attach to the print surface side. In this case, there is a possibility that the adhesive may attach to a section that guides the tape from the rear side toward the front side from the opening. There is thus a possibility that the feeding of the tape may become difficult due to the attached adhesive.

Various embodiments of the broad principles derived herein provide a tape cassette that reduces a possibility of deterioration in feeding of a tape that is a print medium.

Embodiments provide a tape cassette that includes a cassette case, a tape roll, a first rotation body, a first opening, an ink ribbon roll, a second rotation body, and a first regulating part. The cassette case has a bottom plate forming a bottom surface. The tape roll is housed inside the cassette case and a tape that is a print medium is wound on the tape roll. The first rotation body is provided on a first direction side of the tape roll and is positioned on a second direction side of a winding center of the tape roll. The first direction is from one end portion toward another end portion of the bottom plate. The second direction is orthogonal to the first direction and is parallel to the bottom surface. The first rotation body forms a feed path of the tape and is configured to be driven to rotate in accordance with feeding of the tape. The first opening is provided on the second direction side of the first rotation body and penetrates the bottom plate in an orthogonal direction that is orthogonal to the bottom surface. The ink ribbon roll is provided on the second direction side of the first opening and an ink ribbon to be used in printing of the tape is wound on the ink ribbon roll. The second rotation body is provided on the first direction side and the second direction side of a winding center of the ink ribbon roll and forms the feed path. The first regulating part is a wall provided on a fourth direction side of a predetermined path. The predetermined path is a section of the feed path on the second direction side of the first rotation body and on a third direction side of the second rotation body. The third direction is an opposite direction to the second direction. The fourth direction is an opposite direction to the first direction. The first regulating part is positioned on the fourth direction side of a first virtual line. The first virtual line joins an end portion of the first rotation body on the first direction side and an end portion of the second rotation body on the first direction side.

BRIEF DESCRIPTION OF THE DRAWINGS

Embodiments will be described below in detail with reference to the accompanying drawings in which.

DETAILED DESCRIPTION

An embodiment of the present disclosure will be explained with reference to the drawings. A tape printer 1 and a tape cassette 30 according to a present embodiment will be explained. In the explanation of the present embodiment, a lower left side, an upper right side, a lower right side, an upper left side, an upper side, and a lower side in FIG. 1 respectively correspond to a front side, a rear side, a right side, a left side, an upper side, and a lower side of the tape printer 1. A lower right side, an upper left side, an upper right side, a lower left side, an upper side, and a lower side in FIG. 2 respectively correspond to a front side, a rear side, a right side, a left side, an upper side, and a lower side of the tape cassette 30.

In the present embodiment, various tapes (a print tape and a half cut tape 57 that will be explained later, for example) housed in the tape cassette 30 are generically referred to as a tape. Types (a tape width, a print format, a tape color, a character color and the like) of the tape housed in the tape cassette 30 are generically referred to as a tape type.

Figure 2:
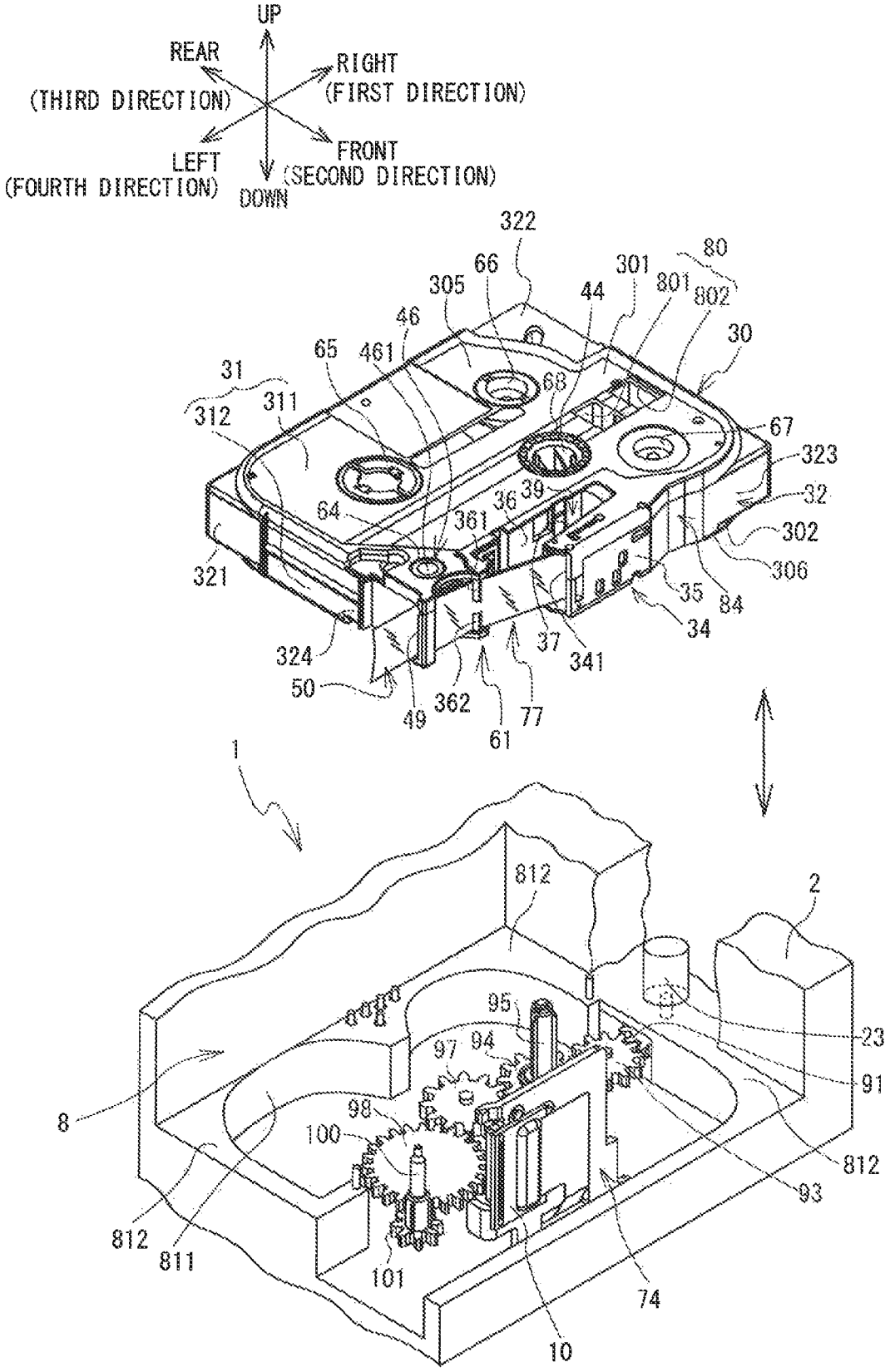
FIG. 2 is a perspective view illustrating a tape cassette and a cassette housing portion.
Figure 3:
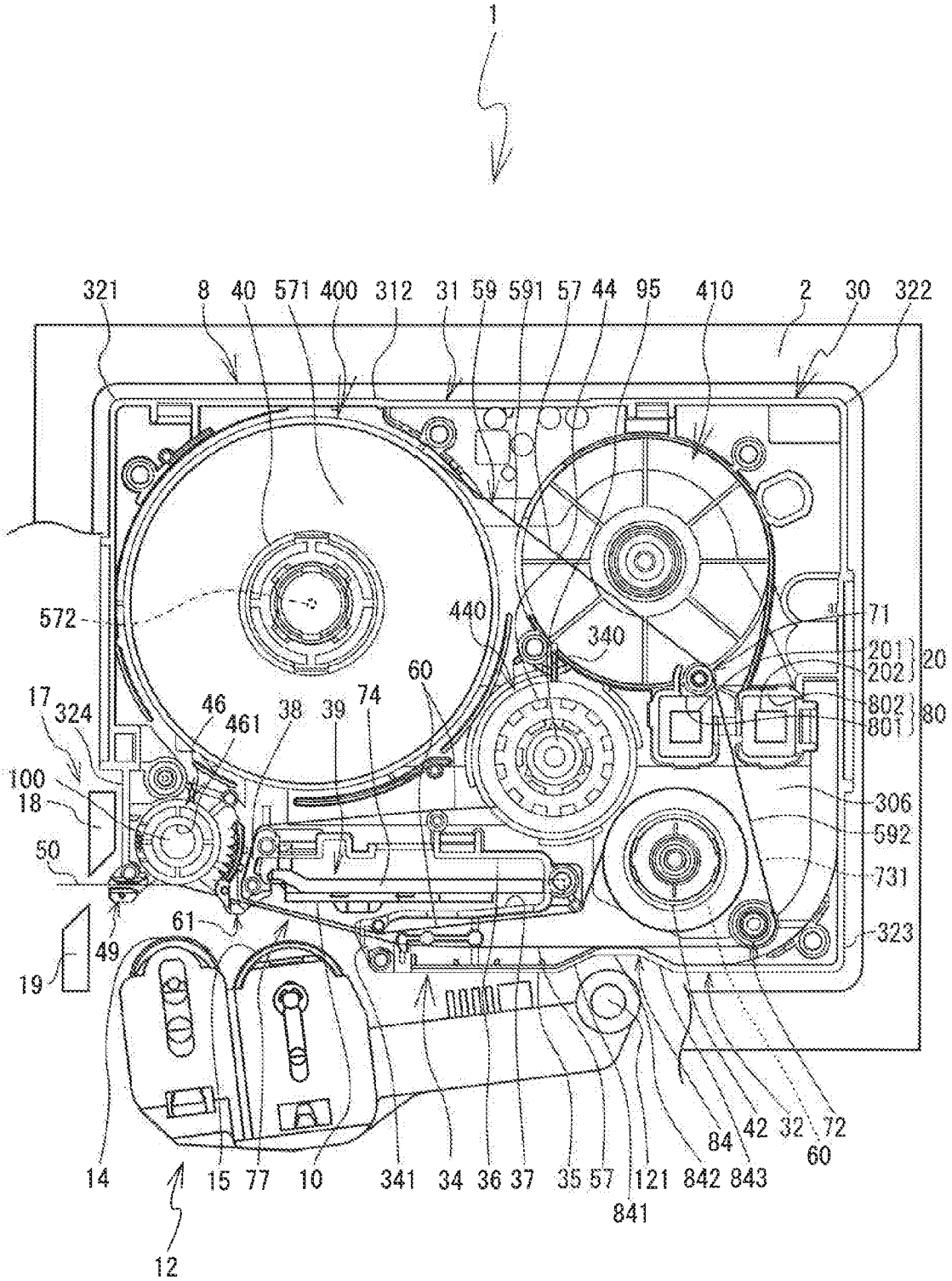
FIG. 3 is a plan view of the cassette housing portion in which the tape cassette 30 is housed.

The tape printer 1 will be explained with reference to FIG. 1 to FIG. 3. For ease of explanation, side walls forming a periphery of a cassette housing portion 8 are illustrated in FIG. 2 and FIG. 3. Since FIG. 2 and FIG. 3 are simply schematic figures, the side walls shown in FIG. 2 and FIG. 3 are drawn to be thicker than in actuality. In actuality, gear groups shown in FIG. 2 that include gears 91, 93, 94, 97, 98, and 101 are covered and hidden by a bottom surface of a cavity 811. In order to illustrate these gear groups, the bottom surface of the cavity 811 is not illustrated in FIG. 2.

An outline configuration of the tape printer 1 will be explained. The tape printer 1 is a general purpose tape printer in which various tape cassettes, such as a thermal type, a receptor type, a laminate type, and a half cut type, can be used in the single printer. The thermal type tape cassette is provided with a heat-sensitive paper tape. The receptor type tape cassette is provided with a print tape and an ink ribbon. The laminate type tape cassette is provided with a double-sided adhesive tape, a film tape, and an ink ribbon. The half cut type tape cassette is provided with a half cut tape and an ink ribbon.

Figure 1:
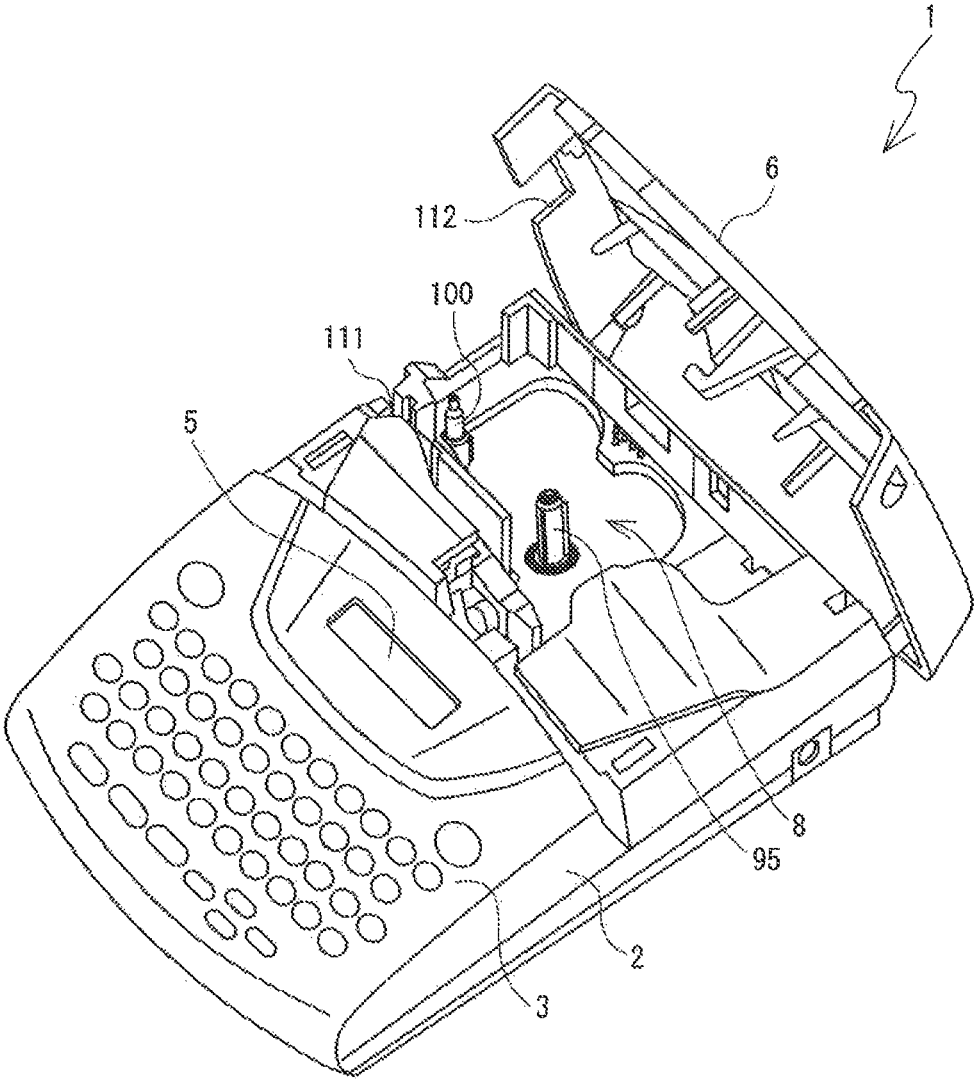
FIG. 1 is a perspective view of a tape printer in a state in which a cassette cover is open.

As shown in FIG. 1, the tape printer 1 is provided with a main body cover 2 that is substantially cuboid. A keyboard 3 is disposed on a front portion of the top surface of the main body cover 2. The keyboard 3 includes character keys and function keys. A display 5 is provided to the rear of the keyboard 3. The display 5 is configured to display characters (letters, numerals, graphics and the like) input using the keyboard 3. A cassette cover 6, which is opened and closed when replacing the tape cassette 30 (refer to FIG. 2), is provided to the rear of the display 5.

The cassette cover 6 is a lid portion that is substantially rectangular in a plan view. The cassette cover 6 is axially supported at both end portions, on the left and the right, above the back surface of the main body cover 2. The cassette cover 6 is configured to swing between a closed position (not shown in the drawings) and an open position shown in FIG. 1. The cassette housing portion 8 is provided inside the main body cover 2. The cassette housing portion 8 is an area into which the tape cassette 30 can be removably mounted.

A discharge slit 111 is provided toward the rear of the left side surface of the main body cover 2. A printed tape is discharged from the cassette housing portion 8 via the discharge slit 111. A discharge window 112 is provided in the left side surface of the cassette cover 6. When the cassette cover 6 is closed, the discharge window 112 exposes the discharge slit 111 to the outside.

An internal configuration of the main body cover 2 below the cassette cover 6 will be explained with reference to FIG. 2. As shown in FIG. 2, the cassette housing portion 8 includes the cavity 811 and corner support portions 812. The cavity 811 is a recessed portion that is recessed so as to substantially correspond to a shape of a bottom surface 302 of a cassette case 31, and that has a planar bottom surface. The corner support portions 812 are planar portions extending horizontally from outer edges of the cavity 811. When the tape cassette 30 is inserted in the cassette housing portion 8, the corner support portions 812 support a bottom surface of peripheral edges of the tape cassette 30.

As shown in FIG. 3, a sensor 20 that includes sensors 201 and 202 is provided in the right portion of the cassette housing portion 8. The sensors 201 and 202 are disposed facing each other in the left-right direction. One of the sensors 201 and 202 is a light emitting portion. The other of the sensors 201 and 202 is a light receiving portion that receives light emitted from the light emitting portion. The sensor 201 is positioned to the left of the sensor 202. When the tape cassette 30 is inserted in the cassette housing portion 8, the sensor 201 is disposed inside an opening 801 that will be described later, and the sensor 202 is disposed inside an opening 802 that will be described later. A pattern is provided within a predetermined range from an end edge of the tape. The sensor 20 detects the pattern provided on the tape passing between the sensor 201 and the sensor 202, and transmits a detection signal to a CPU that is not shown in the drawings. The CPU detects a remaining amount of the tape on the basis of the detection signal.

A head holder 74 is provided in the front portion of the cassette housing portion 8. A thermal head 10, which is provided with a heating element (not shown in the drawings), is installed on the head holder 74. When the tape cassette 30 is inserted in the cassette housing portion 8, the head holder 74 is inserted into a head insertion portion 39 (refer to FIG. 3). A tape drive motor 23 is provided on the outside (the upper right side in FIG. 2) of the cassette housing portion 8. The tape drive motor 23 is a stepping motor. The gear 91 is firmly fixed to a lower end of a drive shaft of the tape drive motor 23. The gear 91 is meshed with the gear 93, via an opening. The gear 93 is meshed with the gear 94. The gear 94 is meshed with the gear 97. The gear 97 is meshed with the gear 98. The gear 98 is meshed with the gear 101.

A ribbon take-up shaft 95 is provided standing on the top surface of the gear 94. The ribbon take-up shaft 95 is a shaft body configured to be inserted into and removed from a ribbon take up spool 44. A tape drive shaft 100 is provided standing on the top surface of the gear 101. The tape drive shaft 100 is a shaft body configured to be inserted into and removed from a hole 461 of a tape drive roller 46.

When the tape cassette 30 is inserted in the cassette housing portion 8, if the tape drive motor 23 drives the gear 91 to rotate in the counterclockwise direction, the ribbon take-up shaft 95 is driven to rotate in the counterclockwise direction via the gear 93 and the gear 94. The ribbon take-up shaft 95 rotationally drives the ribbon take up spool 44 mounted on the ribbon take-up shaft 95. Furthermore, the rotation of the gear 94 is transmitted to the tape drive shaft 100 via the gear 97, the gear 98 and the gear 101, and the tape drive shaft 100 is driven to rotate in the clockwise direction. The tape drive shaft 100 rotationally drives the tape drive roller 46 mounted on the tape drive shaft 100.

As shown in FIG. 3, an arm-shaped platen holder 12 is provided to the front of the head holder 74. The platen holder 12 is pivotably supported around a shaft support portion 121. A platen roller 15 and a movable feed roller 14 are rotatably and axially supported on the leading end side of the platen holder 12. The platen roller 15 faces the thermal head 10, and is configured to be in contact with or separated from the thermal head 10. The movable feed roller 14 faces the tape drive roller 46 mounted on the tape drive shaft 100, and is configured to be in contact with or separated from the tape drive roller 46.

A release lever (not shown in the figures) is coupled to the platen holder 12. The release lever moves in the left-right direction in response to the opening and closing of the cassette cover 6. When the cassette cover 6 is opened, the release lever moves in the right direction, and the platen holder 12 moves toward a stand-by position shown in FIG. 3. In the stand-by position shown in FIG. 3, the platen holder 12 is separated from the cassette housing portion 8, and a user can therefore insert the tape cassette 30 into or remove the tape cassette 30 from the cassette housing portion 8. The platen holder 12 is constantly elastically urged to remain in the stand-by position by a spiral spring that is not shown in the drawings.

When the cassette cover 6 is closed, the release lever moves in the left direction and the platen holder 12 moves to the rear toward a print position (not shown in the drawings). In the print position, the platen holder 12 is in proximity to the cassette housing portion 8. Specifically, when the half cut type tape cassette 30 is inserted in the cassette housing portion 8, the platen roller 15 applies pressure to the thermal head 10 via the half cut tape 57 and an ink ribbon 60. At the same time, the movable feed roller 14 applies pressure to the tape drive roller 46 via the half cut tape 57. In the print position, the tape printer 1 can perform printing using the tape cassette 30 inserted in the cassette housing portion 8.

As shown in FIG. 3, a cutting mechanism 17 is provided to the right of the discharge slit 111 (refer to FIG. 1). The cutting mechanism 17 cuts a printed tape 50 at a predetermined position. The cutting mechanism 17 is provided with a fixed blade 18, and a movable blade 19. The movable blade 19 faces the fixed blade 18 and is configured to move in the forward-rearward direction (in the up-down direction in FIG. 3).

Figure 4:
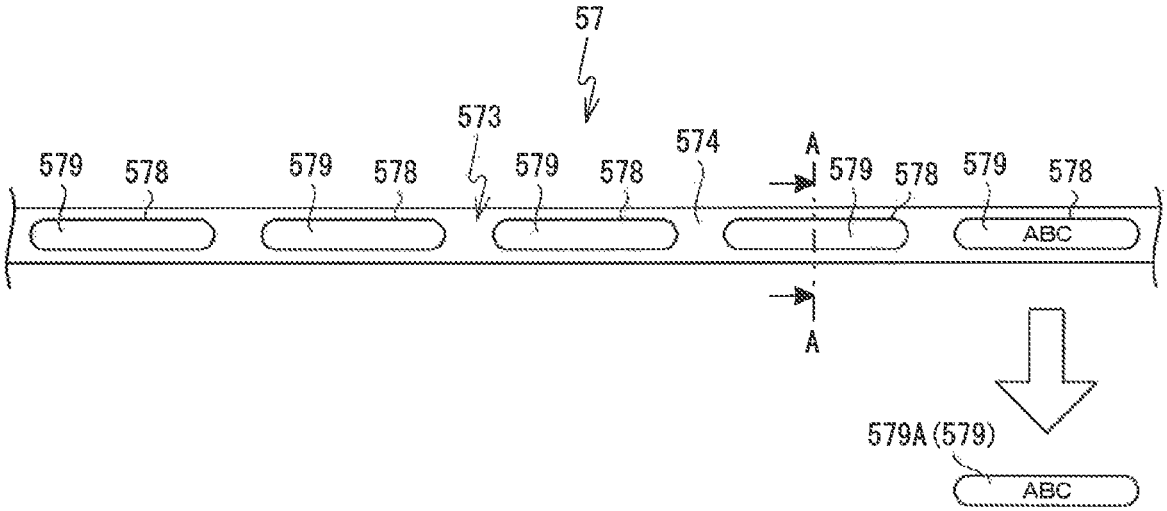
FIG. 4 is a front view of a half cut tape.
Figure 5:
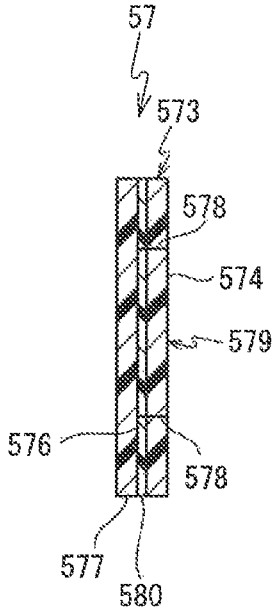
FIG. 5 is a cross-sectional view in the direction of arrows along a line A-A in FIG. 4.

The half cut tape 57 will be explained with reference to FIG. 4 and FIG. 5. The half cut tape 57 is provided with a print paper 573 and a release paper 577 (refer to FIG. 5). As shown in FIG. 5, the print paper 573 has a print surface 574 and an adhesive surface 576. The print surface 574 is used for printing. The adhesive surface 576 is a surface of a layer of an adhesive 580 formed on the surface on the opposite side to the print surface 574. The release paper 577 is adhered to the adhesive surface 576. As shown in FIG. 4 and FIG. 5, cuts 578 are provided in the print paper 573. The cuts 578 are formed from the print surface 574 across to the adhesive surface 576. As shown in FIG. 4, each of the cuts 578 is formed in a substantially rectangular shape whose end portions in a lengthwise direction are rounded. Sections inside the cuts 578 are seals 579. Printing is performed on the seals 579 of the print surface 574, such as "ABC" as shown in FIG. 4, for example. Although not shown in FIG. 4, the half cut tape 57 that has been printed (in other words, the printed tape 50) is cut by the cutting mechanism 17 shown in FIG. 3, and is discharged from the discharge slit 111. As shown by a seal 579A in FIG. 4, the printed seal 579 is peeled from the release paper 577 by the user and is adhered to another object.

An outline configuration of the tape cassette 30 will be explained. The tape cassette 30 is a general purpose cassette that can be mounted in the receptor type, the half cut type, or the like, by changing the type of the tape housed inside the tape cassette 30 as appropriate. In FIG. 2 to FIG. 8, as an example, the tape cassette 30 mounted in the half cut type is shown.

As shown in FIG. 2, the tape cassette 30 is provided with the cassette case 31 that is a housing thereof. The cassette case 31 is overall a substantially rectangular shaped (box shaped) housing with rounded corner portions in a plan view. The cassette case 31 includes a top case 311 and a bottom case 312. The bottom case 312 includes a bottom plate 306 that has the bottom surface 302 of the cassette case 31. The top case 311 includes a top plate 305 that has a top surface 301 of the cassette case 31. The top case 311 is fixed to an upper portion of the bottom case 312.

In the explanation below, a direction toward the right from the left end portion that is one end of the bottom plate 306 toward the right end portion that is the other end of the bottom plate 306 is referred to as a first direction. A direction that is orthogonal to the first direction and parallel to the bottom plate 306 is referred to as a second direction. A direction opposite to the second direction is referred to as a third direction. A direction opposite to the first direction is referred to as a fourth direction. In the present embodiment, the first direction is the rightward direction, and the second direction is the frontward direction. The third direction is the rearward direction and the fourth direction is the leftward direction. The direction orthogonal to the bottom surface 302 is the up-down direction.

In the cassette case 31 of the present embodiment, the whole periphery of the top plate 305 and the bottom plate 306 is surrounded by peripheral walls forming side surfaces. The cassette case 31 has four corner portions 321 to 324, irrespective of the tape type of the tape cassette 30. The corner portions 321 to 324 are formed so as to have the same width (the length is the same in the vertical direction). The corner portions 321 to 324 protrude in an outward direction from the side surfaces of the cassette case 31 such that they form a right angle when seen in a plan view. Since a discharge guide portion 49 is provided in a corner of the front left corner portion 324, the corner portion 324 does not form a right angle. When the tape cassette 30 is inserted in the cassette housing portion 8, the underneath surfaces of the corner portions 321 to 324 are sections supported by the corner support portions 812.

Four support holes 65 to 68 are provided in the cassette case 31. The support holes 65 to 68 rotatably support spools and the like mounted inside the cassette case 31. In the explanation below, the hole portions provided in the rear left side portion, the rear right side portion, and the front right side portion of the cassette case 31 are respectively referred to as the first tape support hole 65, the second tape support hole 66, and the ribbon support hole 67. The hole portion provided between the first tape support hole 65 and the ribbon support hole 67 in a plan view is referred to as the take up spool support hole 68.

Figure 6:
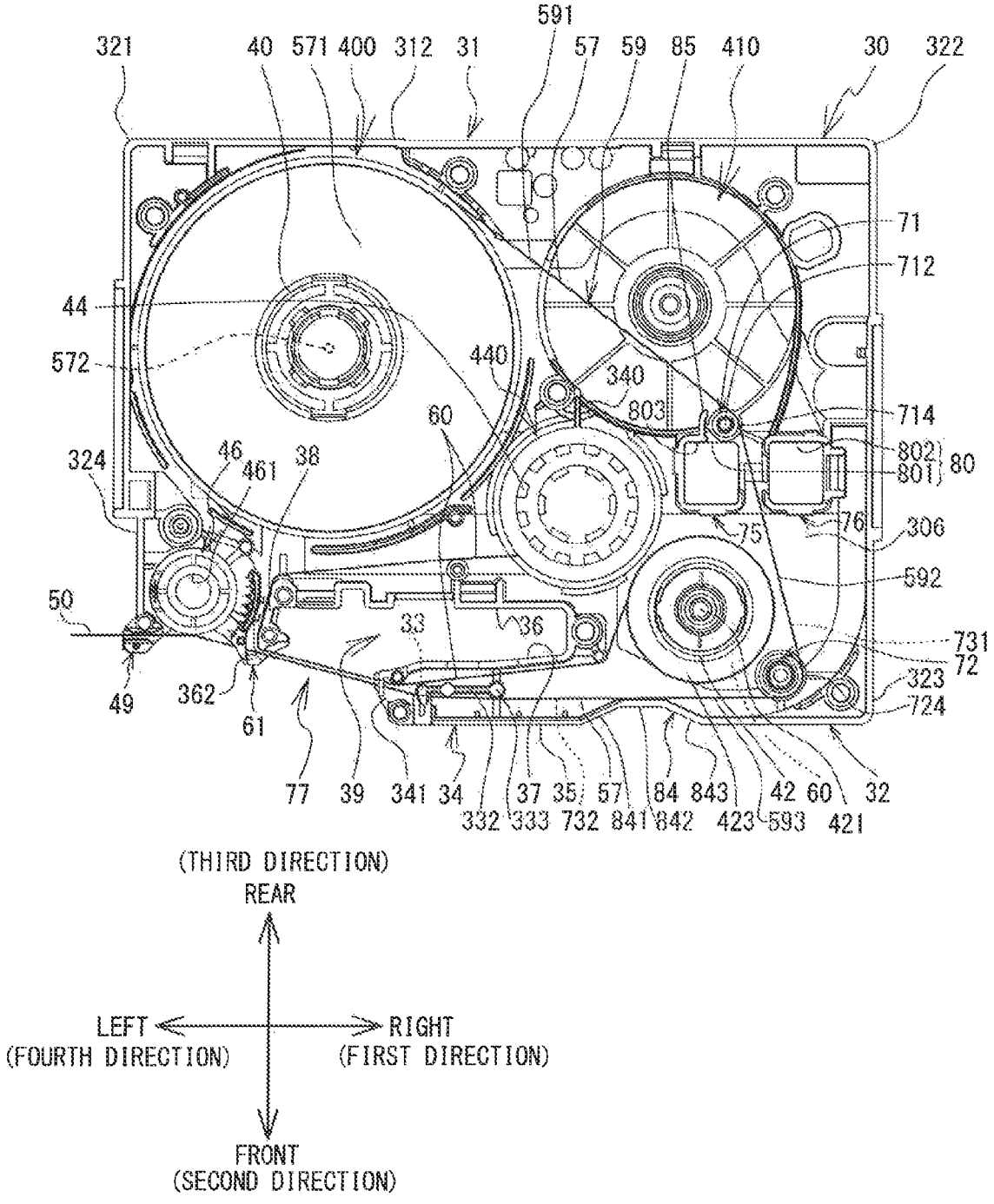
FIG. 6 is a plan view of the tape cassette in a state in which a top case is removed.

The first tape support hole 65 rotatably supports a first tape spool 40 (refer to FIG. 3 and FIG. 6). The ribbon support hole 67 rotatably supports a ribbon spool 42 (refer to FIG. 3 and FIG. 6). The take up spool support hole 68 rotatably supports the ribbon take up spool 44 (refer to FIG. 3 and FIG. 6). A clutch spring 340 (refer to FIG. 3 and FIG. 6) is attached to the lower portion of the ribbon take up spool 44. The clutch spring 340 is a coil spring that inhibits loosening of the taken up ink ribbon 60 due to reverse rotation of the ribbon take up spool 44.

As shown in FIG. 2 and FIG. 6, the wall portion provided on the end portion of the cassette case 31 in the second direction is referred to as a front surface wall 32. The wall portion extending to the left from the right portion of the front surface wall 32 is an arm front surface wall 35. The wall portion provided in the vertical direction in a position separated from the arm front surface wall 35 to the rear is an arm back surface wall 37. A section which is prescribed to the front and to the rear by the arm front surface wall 35 and the arm back surface wall 37 and which extends in the fourth direction from the front right portion of the tape cassette 30 is an arm portion 34. The left end portion of the arm front surface wall 35 bends toward the rear. A gap that extends in the vertical direction between the arm front surface wall 35 and the left end portion of the arm back surface wall 37 is a discharge opening 341. The half cut tape 57 is discharged from the discharge opening 341. The arm portion 34 includes a part of the front surface wall 32. The arm portion 34 extends to the fourth direction side along a third feed path 593 (to be described later), and the discharge opening 341 is provided at the end portion of the arm portion 34 on the fourth direction side. The third feed path 593 is a section, of the feed path of the half cut tape 57, that extends in parallel to the front surface wall 32.

The peripheral wall that extends to the rear from the right end portion of the arm back surface wall 37 and that extends in parallel to the arm back surface wall 37 is a head peripheral wall 36. A space which is prescribed by the arm back surface wall 37 and the head peripheral wall 36, which penetrates the tape cassette 30 in the vertical direction and which is substantially rectangular in a plan view is the head insertion portion 39. The head insertion portion 39 penetrates the bottom plate 306 and the top plate 305 in the vertical direction. The head insertion portion 39 is adjacent to the third direction side of the arm portion 34. The head insertion portion 39 extends in the first direction of the cassette case 31, and is configured to cross a central position of the cassette case 31 in the first direction. The head insertion portion 39 is communicated with the outside on the front surface side of the tape cassette 30, via an exposed portion 77 provided in the front surface side of the tape cassette 30. As shown in FIG. 3, the head holder 74 that supports the thermal head 10 is inserted into the head insertion portion 39.

As shown in FIG. 2 and FIG. 6, a recessed portion 84 is provided in the front surface wall 32 of the cassette case 31. The recessed portion 84 is connected to the end portion of the arm portion 34 on the first direction side, and is recessed in the third direction side. The recessed portion 84 is provided over the up-down direction of the cassette case 31. As shown in FIG. 6, the recessed portion 84 is provided with a first wall portion 841, a second wall portion 842, and a third wall portion 843. The first wall portion 841 extends diagonally to the right and to the rear from the end portion in the first direction of the arm front surface wall 35. The second wall portion 842 extends in the first direction from the end portion in the first direction of the first wall portion 841. The third wall portion 843 extends diagonally to the right and to the front from the end portion in the first direction of the second wall portion 842. When the tape cassette 30 is inserted into the cassette housing portion 8, the recessed portion 84 is a relief portion provided such that there is no interference between the shaft support portion 121 of the platen holder 12 and the cassette case 31.

A first tape area 400 and a second tape area 410 are provided inside the cassette case 31. The first tape area 400 is an area in which the tape can be housed. The first tape area 400 is adjacent to the corner portion 321 of the rear left portion of the cassette case 31. The first tape area 400 is an area that is substantially circular in a plan view and that occupies approximately all the left half of the inside of the cassette case 31. The second tape area 410 is adjacent to the corner portion 322 of the rear right portion of the cassette case 31. The second tape area 410 is an area that is substantially circular in a plan view, and is provided in the rear right portion inside the cassette case 31. In the present embodiment, the tape is not housed in the second tape area 410. However, if the tape cassette 30 is the laminate cassette, for example, the film tape that is the print medium may be housed in the second tape area 410.

When the tape cassette 30 is the half cut type, a tape roll 571, on which the half cut tape 57 is wound, is housed in the first tape area 400. A first rotation body 71 is provided on the first direction side of the tape roll 571, and on the second direction side of a winding center 572 of the tape roll 571. The first rotation body 71 is positioned in a front portion of the second tape area 410.

Figure 8:
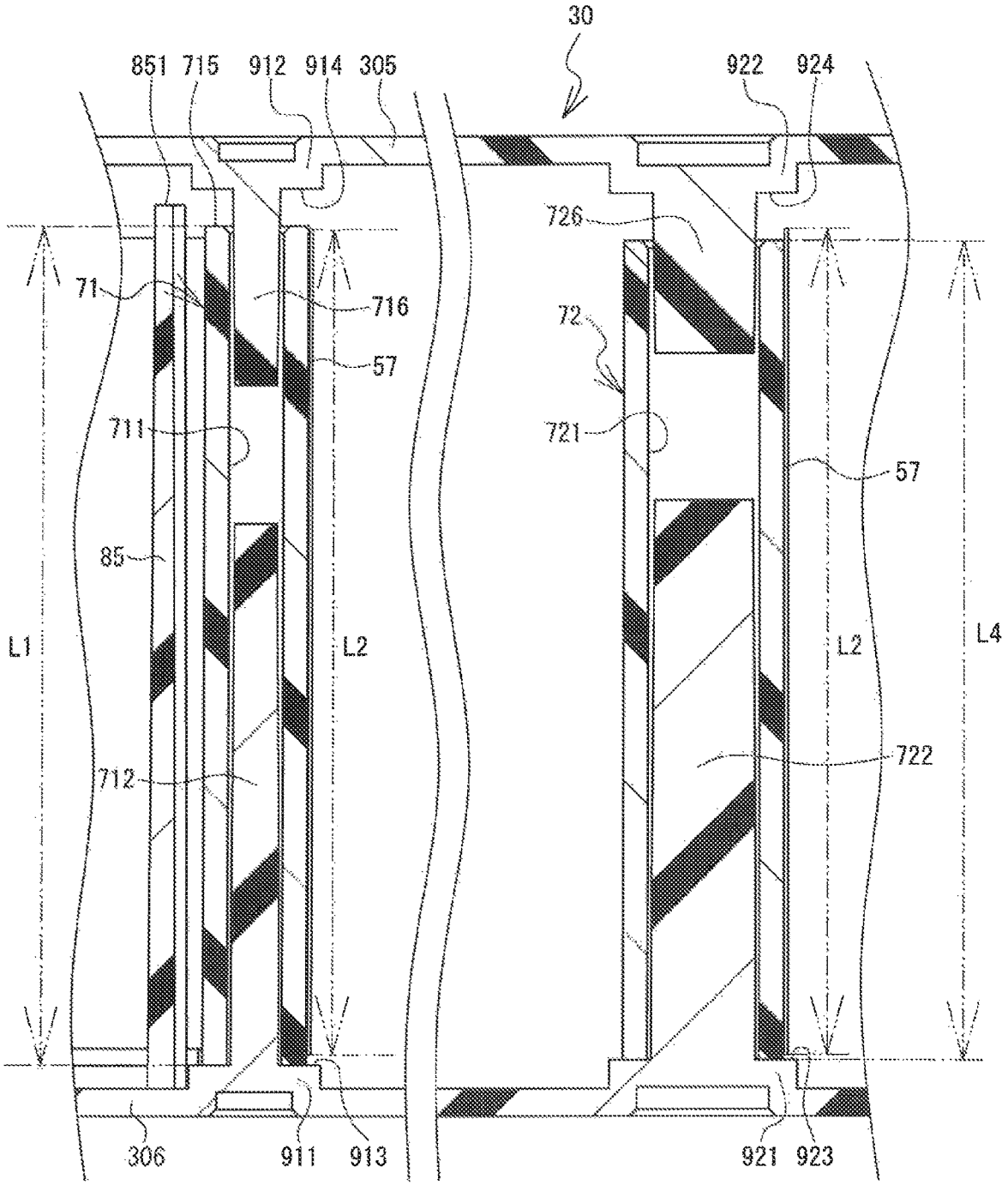
FIG. 8 is a view in which a vertical cross section in the left-right direction of a periphery of an extension wall portion and a first rotation body is aligned next to a vertical cross section in the left-right direction of a periphery of a second rotation body.

As shown in FIG. 8, the first rotation body 71 is cylindrically shaped and is provided with a through hole 711 that penetrates in the vertical direction. A support shaft 712 and a support shaft 716 are inserted into the through hole 711. A section of the bottom plate 306 below the first rotation body 71 is a protruding portion 911. The protruding portion 911 protrudes upward and is circular in a plan view. The support shaft 712 is cylindrically shaped and extends upward from a center portion of a surface 913 that is on the top side of the protruding portion 911, in the bottom plate 306. A section of the top plate 305 that is above the first rotation body 71 is a protruding portion 912. The protruding portion 912 protrudes downward and is circular in a plan view. The support shaft 716 is cylindrically shaped and extends downward from a center portion of a surface 914 that is on the bottom side of the protruding portion 912, in the top plate 305. The lower end of the first rotation body 71 is in contact with the surface 913 as a result of gravitational force.

Figure 7:
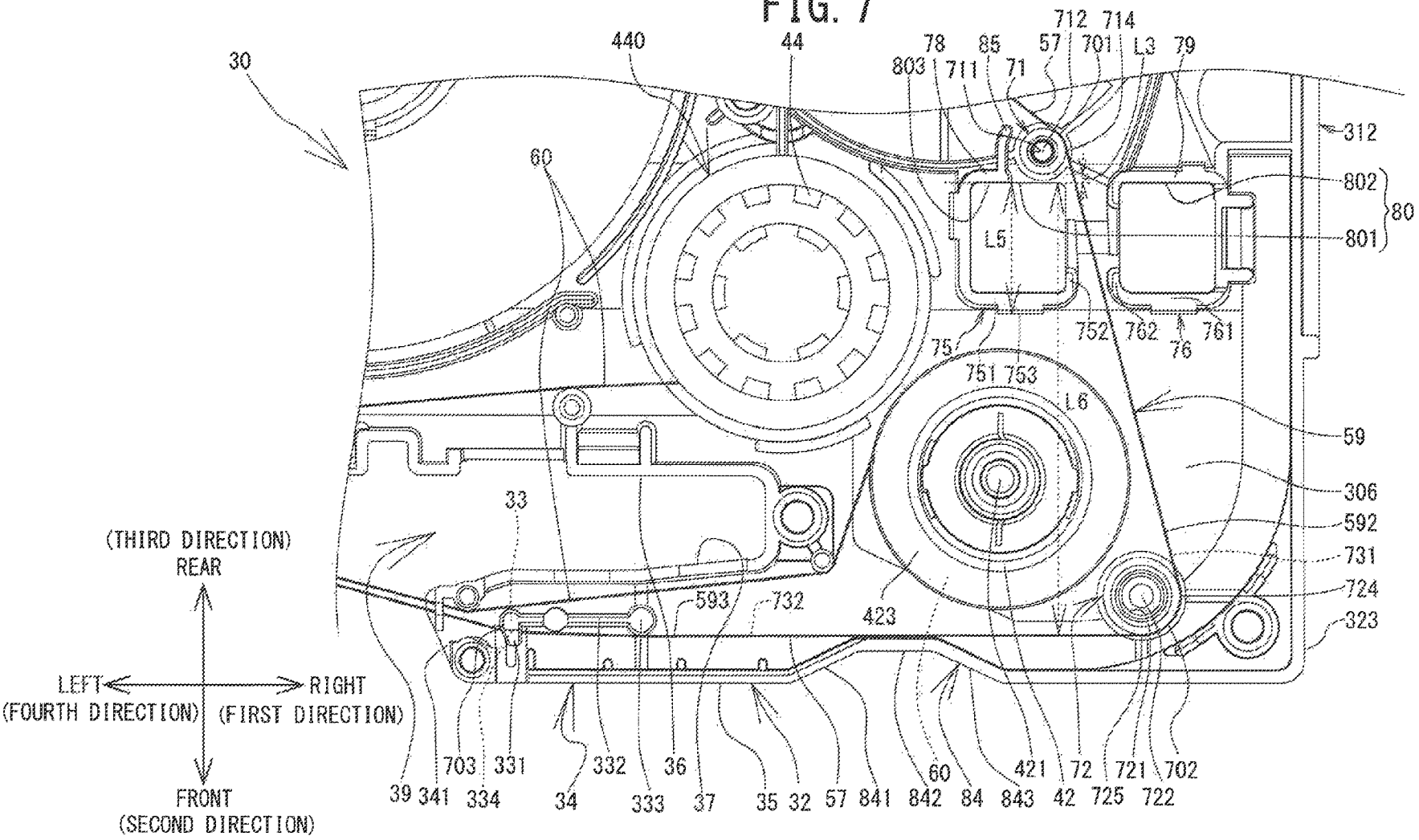
FIG. 7 is an enlarged view of major components of the tape cassette in a state in which the top case is removed.

As shown in FIG. 7, the first rotation body 71 forms the feed path of the half cut tape 57 that is pulled out from the tape roll 571. The first rotation body 71 is configured to be driven to rotate in the clockwise direction in a plan view, in accordance with the feeding of the half cut tape 57. The first rotation body 71 is in contact with the half cut tape 57 regardless of an amount of the tape roll 571 stored in the first tape area 400. As shown in FIG. 8, a length L1 of the first rotation body 71 in the vertical direction is longer than a length L2 of the half cut tape 57 in the vertical direction.

As shown in FIG. 7, an opening 80 is provided on the second direction side of the first rotation body 71. The opening 80 includes the pair of openings 801 and 802, each of which is rectangular and long in the front-rear direction in a plan view. The openings 801 and 802 are disposed side by side in the left-right direction so as to be separated from each other. The openings 801 and 802 penetrate the bottom plate 306 and the top plate 305 (refer to FIG. 2) in the vertical direction. More specifically, the first rotation body 71 faces a right portion of the opening 801, in the front-rear direction. The opening 802 is positioned in the first direction with respect to the opening 801. In the front-rear direction, a distance L3 between the first rotation body 71 and the opening 80 is shorter than a diameter of the first rotation body 71.

The ribbon spool 42 is provided on the second direction side of the opening 80. The ink ribbon 60, which is used for printing on the half cut tape 57, is wound on the ribbon spool 42. The ink ribbon 60 faces the opening 801 in the front-rear direction. The ribbon spool 42 is positioned on the first direction side of the head insertion portion 39. Flange portions 423 are provided on the end portions of the ribbon spool 42 in the vertical direction. The flange portions 423 protrude outward in a radial direction of the ribbon spool 42. In FIG. 7, only the flange portion 423 on the top side is illustrated. The unused ink ribbon 60 is wound on the ribbon spool 42. The wound ink ribbon 60 is positioned between the top and bottom flange portions 423.

The ribbon take up spool 44, on which the ink ribbon 60 is wound after being used for the printing, is provided on the third direction side and the fourth direction side of the ribbon spool 42. The ribbon take up spool 44 is provided between the first tape area 400 and the ribbon spool 42.

A second rotation body 72 is disposed to diagonally to the right and the front of the ribbon spool 42. The second rotation body 72 is provided on the first direction side and the second direction side of a winding center 421 of the ribbon spool 42. As shown in FIG. 8, the second rotation body 72 is cylindrically shaped and is provided with a through hole 721 that penetrates in the vertical direction. A support shaft 722 and a support shaft 726 are inserted into the through hole 721. A section of the bottom plate 306 below the second rotation body 72 is a protruding portion 921. The protruding portion 921 protrudes upward and is circular in a plan view. The support shaft 722 is cylindrically shaped and extends upward from a center portion of a surface 923 that is on the top side of the protruding portion 921, in the bottom plate 306. A section of the top plate 305 that is above the second rotation body 72 is a protruding portion 922. The protruding portion 922 protrudes downward and is circular in a plan view. The support shaft 726 is cylindrically shaped and extends downward from a center portion of a surface 924 that is on the bottom side of the protruding portion 922, in the top plate 305. The lower end of the second rotation body 72 is in contact with the surface 923 as a result of gravitational force.

As shown in FIG. 7, the second rotation body 72 forms the feed path of the half cut tape 57 that is pulled out from the tape roll 571. The second rotation body 72 is configured to be driven to rotate in the clockwise direction in a plan view, in accordance with the feeding of the half cut tape 57. As shown in FIG. 8, a length L4 of the second rotation body 72 in the vertical direction is shorter than the length L2 of the half cut tape 57 in the vertical direction. As shown in FIG. 7, the diameter of the first rotation body 71 is shorter than the diameter of the second rotation body 72. As shown in FIG. 8, the position of the surface 923 is higher than that of the surface 913 in the vertical direction. The position of the surface 924 is lower than that of the surface 914 in the vertical direction. A material of the first rotation body 71 and the second rotation body 72 is ABS resin, for example.

A guide portion 33 is provided on the end portion of the arm portion 34 on the fourth direction side. The guide portion 33 guides the half cut tape 57 to the discharge opening 341. The guide portion 33 extends in the vertical direction. The rear end portion of the guide portion 33 is rounded. The front end portion of the guide portion 33 is parallel to the left-right direction. Protruding portions 331 are provided on the end portions of the guide portion 33 in the vertical direction. The protruding portions 331 protrude in the second direction. In FIG. 7, only the protruding portion 331 on the top side is illustrated. The half cut tape 57 is disposed between the top and bottom protruding portions 331 and is guided while being in contact with the guide portion 33. A wall portion 332 extends in the first direction from the right portion of the guide portion 33. A cylindrical portion 333 is provided on the end portion of the wall portion 332 on the first direction side. The cylindrical portion 333 extends in the vertical direction.

In the explanation below, of the feed path of the tape roll 571 shown in FIG. 6, the feed path along which the half cut tape 57 is pulled out from the rear right portion of the tape roll 571 toward the front right and is fed to the outside via the first rotation body 71, the second rotation body 72, the guide portion 33 and the discharge opening 341 is referred to as a feed path 59. Of the feed path 59, the feed path on the first direction side of the tape roll 571 and on the fourth direction side of the first rotation body 71 is referred to as a first feed path 591. Of the feed path 59, the feed path on the second direction side of the first rotation body 71 and on the third direction side of the second rotation body 72 is referred to as a second feed path 592. Of the feed path 59, the feed path on the fourth direction side of the second rotation body 72 and on the first direction side of the guide portion 33 is referred to as the third feed path 593.

The feed path 59 is oriented toward the first rotation body 71 from the tape roll 571. The feed path 59 bends at an obtuse angle toward the head insertion portion 39 at the first rotation body 71. The feed path 59 bends at an acute angle toward the head insertion portion 39 at the second rotation body 72. The feed path 59 bends at an obtuse angle toward the head insertion portion 39 at the guide portion 33. In the present embodiment, locations at which the feed path 59 bends toward the head insertion portion 39, that is, bends toward the inside of the cassette case 31, are only three locations of the first rotation body 71, the second rotation body 72, and the guide portion 33. As shown in FIG. 7, a portion of the feed path 59 bent by the first rotation body 71 is referred to as a bent portion 701. A portion of the feed path 59 bent by the second rotation body 72 is referred to as a bent portion 702. A portion of the feed path 59 bent by the guide portion 33 is referred to as a bent portion 703. The plurality of bent portions 701 to 703 at which the feed path 59 bends all bend toward the head insertion portion 39 side.

The feed path 59 of the present embodiment is a path on which the half cut tape 57 is positioned in a state in which there is no slack in the half cut tape 57. For example, the feed path 59 is a path when tension is applied to the half cut tape 57 from the discharge opening 341 toward regulating members 361 and 362 (refer to FIG. 2) that will be described later.

A virtual line joining an end portion 714 on the first direction side of the first rotation body 71 and an end portion 724 on the first direction side of the second rotation body 72 is referred to as a first virtual line 731. In the present embodiment, the second feed path 592 and the first virtual line 731 are on the same line. A virtual line joining an end portion 725 on the second direction side of the second rotation body 72 and an end portion 334 on the second direction side of the guide portion 33 is referred to as a second virtual line 732. In the present embodiment, the third feed path 593 and the second virtual line 732 are on the same line.

A first regulating part 75 is provided on the fourth direction side of the second feed path 592 and the fourth direction side of the first virtual line 731. A second regulating part 76 is provided facing the first regulating part 75 in the left-right direction. The second regulating part 76 is provided facing the first regulating part 75 such that the second feed path 592 is sandwiched therebetween. The second regulating part 76 is positioned on the first direction side of the first virtual line 731.

The first regulating part 75 includes a wall portion 751 and a wall portion 752. The wall portion 751 extends in the left-right direction along the opening 80, and more specifically, along the end portion on the second direction side of the opening 801. The wall portion 752 extends in the third direction from the end portion of the wall portion 751 in the first direction. The end portion of the wall portion 752 in the third direction is on the second direction side of the center, in the front-rear direction, of the opening 801.

The second regulating part 76 includes a wall portion 761 and a wall portion 762. The wall portion 761 extends in the left-right direction along the opening 80, and more specifically, along the end portion on the second direction side of the opening 802. The wall portion 762 extends in the third direction from the end portion of the wall portion 761 in the fourth direction. The end portion of the wall portion 762 in the third direction is on the second direction side of the center, in the front-rear direction, of the opening 802.

A distance from an end portion 803 on the third direction side of the opening 801 in the front-rear direction to an end portion 753 on the second direction side of the first regulating part 75 is a first distance L5. A distance from the end portion 803 on the third direction side of the opening 801 in the front-rear direction to the end portion 725 on the second direction side of the second rotation body 72 is a second distance L6. The first distance L5 is equal to or less than one third of the second distance L6. In FIG. 7, the first distance L5 is set to be smaller than one third of the second distance L6.

A wall portion 78 is provided around the left end portion and the rear left portion of the opening 801. The wall portion 78 is connected to the end portion in the fourth direction of the first regulating part 75. A wall portion 79 is provided around the right end portion, the rear end portion, and the rear left portion of the opening 802. The wall portion 79 is connected to the end portion in the first direction of the second regulating part 76.

An extension wall portion 85 is connected to the right end of the rear end portion of the wall portion 78. The extension wall portion 85 extends to the fourth direction side of the first rotation body 71 from the opening 80, more specifically, the end portion 803 on the third direction side of the opening 801. The extension wall portion 85 curves in line with the first rotation body 71. As shown in FIG. 8, the position of a top end 851 of the extension wall portion 85 is higher than the position of a top end 715 of the first rotation body 71.

As shown in FIG. 7, the recessed portion 84 is positioned on the second direction side of the second virtual line 732. Thus, a section of the third feed path 593 that faces the recessed portion 84 does not bend in a direction away from the head insertion portion 39. Further, the cylindrical portion 333 and the wall portion 332 of the arm portion 34 are positioned on the third direction side of the second virtual line 732. Thus, a section of the third feed path 593 that faces the cylindrical portion 333 and the wall portion 332 does not bend toward the head insertion portion 39.

As shown in FIG. 6, a separating portion 61 is provided on the left side of the head insertion portion 39. The separating portion 61 is a portion that separates the half cut tape 57 and the ink ribbon 60 that have been used for the printing, on the downstream side of the exposed portion 77 in the tape feed direction. The separating portion 61 includes the regulating members 361 and 362 (refer to FIG. 2), a ribbon guide wall 38, and the like.

The tape drive roller 46 is rotatably and axially supported (refer to FIG. 2) on the left side (namely, the downstream side on the feed path) of the separating portion 61. The surface on the front side, which is a part of the outer peripheral surface of the tape drive roller 46, is exposed to the outside of the cassette case 31 and comes into contact with the half cut tape 57.

The discharge guide portion 49 is provided on the downstream side, in the feed direction, of the tape drive roller 46. The discharge guide portion 49 is provided so as to be slightly separated, to the front, from the front end portion of the left side surface of the cassette case 31. The discharge guide portion 49 is a plate-shaped member that extends between the top surface 301 and the bottom surface 302. The printed tape 50 is fed via the tape drive roller 46. The discharge guide portion 49 guides the fed printed tape 50 into a path formed between the discharge guide portion 49 and the front end portion of the left side surface of the cassette case 31. The printed tape 50 is discharged to the outside of the tape cassette 30 from an end of this path.

The feeding and the printing of the half cut tape 57 will be explained. As shown in FIG. 3, the half cut type tape cassette 30 is mounted in the cassette housing portion 8. The sensors 201 and 202 and disposed inside the openings 801 and 802. The half cut tape 57 is pulled out from the tape roll 571 as a result of the tape drive roller 46 working in concert with the movable feed roller 14. The tape roll 571 rotates in the clockwise direction in a plan view in accordance with the pulling out of the half cut tape 57. The half cut tape 57 pulled out from the tape roll 571 is moved toward the first rotation body 71 through the first feed path 591. The half cut tape 57 is moved toward the second rotation body 72 through the second feed path 592, and is fed to the arm portion 34.

Meanwhile, the ribbon take up spool 44 rotates in the counterclockwise direction in a plan view in accordance with the driving of the ribbon take-up shaft 95, and pulls out the ink ribbon 60 from the ribbon spool 42. The ribbon spool 42 rotates in the counterclockwise direction in a plan view in accordance with the pulling out of the ink ribbon 60. The ink ribbon 60 pulled out from the ribbon spool 42 is fed toward the arm portion 34.

Inside the arm portion 34, the half cut tape 57 passes through the third feed path 593 that extends substantially in parallel to the arm front surface wall 35. The half cut tape 57 is bent diagonally to the left and to the rear by the guide portion 33, and is discharged from the discharge opening 341 to the exposed portion 77. The ink ribbon 60 passes inside the arm portion 34, on the third direction side of the cylindrical portion 333, the wall portion 332, and the guide portion 33. The ink ribbon 60 is overlaid with the half cut tape 57 and is discharged from the discharge opening 341 to the exposed portion 77.

In the exposed portion 77, the release paper 577 (refer to FIG. 5) of the half cut tape 57 discharged from the discharge opening 341 is exposed to the front. In the exposed portion 77, the print surface 574 (refer to FIG. 4 and FIG. 5) of the discharged half cut tape 57 faces the thermal head 10. The thermal head 10 uses the ink ribbon 60 to perform printing on the half cut tape 57 positioned at the exposed portion 77.

After the printing is performed, the ink ribbon 60 is separated from the half cut tape 57 by the separating portion 61. The ink ribbon 60 moves along the ribbon guide wall 38 and is taken up by the ribbon take up spool 44. After the printing, the half cut tape 57, that is, the printed tape 50, is guided to the downstream side in the tape feed direction by the regulating members 361 and 362. The printed tape 50 is fed toward the discharge guide portion 49 via the space between the tape drive roller 46 and the movable feed roller 14. The printed tape 50 is discharged to the outside from the discharge guide portion 49. The printed tape 50 is obtained in this manner.

The tape cassette 30 according to the present embodiment is configured and the printing is performed as described above. In the present embodiment, as shown in FIG. 7, the half cut tape 57 pulled out from the tape roll 571 is guided by the first rotation body 71 toward the second rotation body 72 on the third direction side of the opening 80. Thus, in comparison to a case in which the half cut tape 57 is guided by a wall portion that does not rotate, the frictional force between the half cut tape 57 and the first rotation body 71 is reduced. As a result, the possibility that the adhesive 580 (refer to FIG. 5) of the half cut tape 57 becomes attached to the first rotation body 71 may be reduced. Therefore, the possibility may be reduced that the half cut tape 57 is less easily fed due to the adhesive 580.

The first regulating part 75 is positioned on the fourth direction side of the first virtual line 731. As a result, in comparison to a case in which the first regulating part 75 is positioned on the first virtual line 731 or is positioned on the first direction side of the first virtual line 731, the surface of the half cut tape 57 on the fourth direction side, namely, the print surface 574, does not easily come into contact with the first regulating part 75. As a result, the possibility of the adhesive 580 of the tape becoming attached to the first regulating part 75 may be reduced. Therefore, the possibility may be reduced that the half cut tape 57 is less easily fed due to the adhesive 580.

In the front-rear direction, the distance L3 between the first rotation body 71 and the opening 80 is shorter than the diameter of the first rotation body 71. Thus, in comparison to a case in which the distance L3 between the first rotation body 71 and the opening 80 is equal to or greater than the diameter of the first rotation body 71, the first rotation body 71 is closer to the opening 80, and the position of the half cut tape 57 at the opening 80 is stable. As a result, for example, when the sensor 20 (refer to FIG. 3) is inserted in the opening 80, the possibility may be reduced that the sensor 20 comes into contact with the half cut tape 57 and the half cut tape 57 is warped. Further, in a case in which a rod-shaped object other than the sensor 20 is inserted in the opening 80, the possibility may be reduced that the object comes into contact with the half cut tape 57 and the half cut tape 57 is warped. As a result, the possibility may be reduced that the half cut tape 57 becomes warped and is less easily fed.

The first regulating part 75 is positioned on the fourth direction side of the first virtual line 731, and the second regulating part 76 is positioned on the first direction side of the first virtual line 731. The release paper 577 forms the first direction side surface of the half cut tape 57 between the first rotation body 71 and the second rotation body 72. In comparison to a case in which the second regulating part 76 is positioned on the first virtual line 731 or is positioned on the fourth direction side of the first virtual line 731, the release paper 577 is less likely to come into contact with the second regulating part 76 between the first rotation body 71 and the second rotation body 72. The first regulating part 75 is positioned on the fourth direction side of the first virtual line 731. Thus, the half cut tape 57 extends in a straight line along the first virtual line 731 from the first rotation body 71 toward the second rotation body 72. As a result, the possibility may be reduced that the half cut tape 57 bends at the second regulating part 76 and that frictional force occurs between the half cut tape 57 and the second regulating part 76. Therefore, the possibility may be reduced that the half cut tape 57 is less easily fed.

The feed path 59 only bends toward the head insertion portion 39, that is, toward the inside of the cassette case 31, at the three locations of the first rotation body 71, the second rotation body 72, and the guide portion 33. Thus, in comparison to a case in which there are four or more locations at which the feed path 59 bends toward the head insertion portion 39, the frictional force is less likely to occur. Therefore, the possibility may be reduced that the half cut tape 57 is less easily fed due to the frictional force.

The recessed portion 84 is positioned on the second direction side of the second virtual line 732. Thus, the possibility may be reduced that the half cut tape 57 bends in a direction away from the head insertion portion 39 due to the recessed portion 84. As a result, the possibility may be reduced that the half cut tape 57 bends at the recessed portion 84 and that frictional force occurs between the half cut tape 57 and the recessed portion 84. Therefore, the possibility may be reduced that the half cut tape 57 is less easily fed.

On the feed path 59, the plurality of bent portions 701 to 703 all bend toward the head insertion portion 39, namely, toward the inside of the cassette case 31. Thus, in comparison to a case in which there is a location where the feed path 59 bends in a direction away from the head insertion portion 39, it is possible to reduce frictional force, and the possibility may be reduced that the half cut tape 57 is less easily fed.

The lower case 312 is provided with the extension wall portion 85. Thus, when the half cut tape 57 is disposed in the feed path 59 in a manufacturing process, due to the extension wall portion 85, the half cut tape 57 is less easily disposed on the fourth direction side of the first rotation body 71. The possibility may thus be reduced that the half cut tape 57 is disposed on the fourth direction side of the first rotation body 71 and is not guided to the first rotation body 71. Therefore, the possibility may be reduced that the half cut tape 57 is less easily fed.

As shown in FIG. 8, the position of the top end 851 of the extension wall portion 85 is higher than the position of the top end 715 of the first rotation body 71. Thus, in comparison to a case in which the position of the top end 851 of the extension wall portion 85 is lower than the position of the top end 715 of the first rotation body 71, when the half cut tape 57 is disposed on the feed path in the manufacturing process, the half cut tape 57 is less easily disposed on the fourth direction side of the first rotation body 71 due to the extension wall portion 85. The possibility may thus be reduced that the half cut tape 57 is disposed on the fourth direction side of the first rotation body 71 and is not guided to the first rotation body 71. Therefore, the possibility may be reduced that the half cut tape 57 is less easily fed.

As shown in FIG. 7, the first distance L5 is equal to or less than one third of the second distance L6. Thus, in comparison to a case in which the first distance L5 is larger than one third of the second distance L6, the distance between the first rotation body 71 and the second rotation body 72 becomes shorter. As a result, the half cut tape 57 is less likely to become slack between the first rotation body 71 and the second rotation body 72. Thus, the position of the half cut tape 57 at the opening 80 is stable. Thus, for example, when the sensor 20 is inserted in the opening 80, the possibility may be reduced that the sensor 20 comes into contact with the half cut tape 57. The possibility of warping of the half cut tape 57 may therefore be reduced. Further, in a case in which a rod-shaped object other than the sensor 20 is inserted, the possibility may be reduced that the object comes into contact with the half cut tape 57. The possibility of warping of the half cut tape 57 may therefore be reduced. As a result, the possibility may be reduced that the half cut tape 57 becomes warped and is less easily fed.

The second rotation body 72 is configured to be driven to rotate in accordance with the feeding of the half cut tape 57. In this case, for example, in comparison to a case in which the second rotation body 72 rotates in reverse to the feed direction of the half cut tape 57, the frictional force between the second rotation body 72 and the half cut tape 57 becomes smaller. Thus, the possibility may be reduced that the adhesive 580 of the half cut tape 57 attaches to the second rotation body 72. Therefore, the possibility may be reduced that the tape is less easily fed due to the adhesive 580.

The diameter of the first rotation body 71 is smaller than the diameter of the second rotation body 72. Thus, in comparison to a case in which the diameter of the first rotation body 71 is equal to or greater than that of the second rotation body 72, the distance that the half cut tape 57 passes from the end portion 714 on the first direction side of the first rotation body 71 to the opening 80 is shorter. As a result, the position of the half cut tape 57 at the opening 80 is stable. Thus, for example, when the sensor 20 is inserted into the opening 80, the possibility that the sensor 20 comes into contact with the half cut tape 57 may be reduced. The possibility of warping of the half cut tape 57 may therefore be reduced. Further, when the rod-shaped object that is not the sensor 20 is inserted from the opening 80, the possibility of contact with the half cut tape 57 may be reduced. The possibility of warping of the half cut tape 57 may therefore be reduced. As a result, the possibility may be reduced that the half cut tape 57 becomes warped and is less easily fed.

As shown in FIG. 8, the length L1 of the first rotation body 71 in the vertical direction is longer than the length L2 of the half cut tape 57 in the vertical direction, and the length L4 of the second rotation body 72 in the vertical direction is shorter than the length L2 of the half cut tape 57 in the vertical direction. In comparison to a case in which the length L1 of the first rotation body 71 in the vertical direction is equal to or less than the length L2 of the half cut tape 57 in the vertical direction, the end portions of the half cut tape 57 in the vertical direction are easily positioned on the inside of the end portions of the first rotation body 71 in the vertical direction. Thus, the possibility may be reduced that the end portions of the half cut tape 57 in the vertical direction may come into contact with the surfaces 913 and 914 of the tape cassette 30 that are positioned to the outside of the first rotation body 71 in the vertical direction and that frictional force may thus occur. Further, in comparison to a case in which the length L4 of the second rotation body 72 in the vertical direction is equal to or greater than the length L2 of the half cut tape 57 in the vertical direction, the end portions of the half cut tape 57 in the vertical direction easily come into contact with the surfaces 923 and 924 of the tape cassette 30 that are positioned to the outside of the second rotation body 72 in the vertical direction. As a result, the feeding of the half cut tape 57 is easily made stable. The second rotation body 72 is positioned on the downstream side of the first rotation body 71 on the feed path. Thus, the second rotation body 72 is close to the position at which the printing is performed on the half cut tape 57. Therefore, the tape cassette 30 of the present embodiment may reduce the possibility of frictional force occurring at the first rotation body 71. Further, the tape cassette 30 of the present embodiment may cause the feeding of the half cut tape 57 to be stable at the second rotation body 72 that is close to the position at which the printing is performed. Therefore, the possibility may be reduced that the half cut tape 57 is less easily fed due to the frictional force. Further, the feeding of the half cut tape 57 may be made stable and print quality may be improved.

As shown in FIG. 4 and FIG. 5, the cuts 578 are provided in the half cut tape 57. Thus, in comparison to a case in which the cuts 578 are not provided, the adhesive 580 (refer to FIG. 5) may easily attach to the print surface 574 side. However, in the present embodiment, the half cut tape 57 is guided toward the second rotation body 72 on the third direction side of the opening 80, by the first rotation body 71. As a result, in comparison to the case in which the half cut tape 57 is guided by the wall portion that does not rotate, the possibility that the adhesive 580 becomes attached to the first rotation body 71 may be reduced. Therefore, the possibility may be reduced that the half cut tape 57 is less easily fed due to the adhesive 580.

The present disclosure is not limited to the above-described embodiment, and various modifications are possible. For example, in the cassette case 31 of the present embodiment, the whole periphery of the top plate 305 and the bottom plate 306 is surrounded by the peripheral wall that forms the side surfaces. However, the whole periphery of the top plate 305 and the bottom plate 306 need not necessarily be surrounded by the peripheral wall. For example, an opening may be provided in a part of the peripheral wall (the back surface, for example) such that the interior of the cassette case 31 is exposed. For example, a boss that connects the top plate 305 and the bottom plate 306 may be provided in a position facing the opening provided in the part of the peripheral wall. For example, the whole of the peripheral wall forming the side surfaces around the periphery of the top plate 305 and the bottom plate 306 need not necessarily be provided.

The length L1 of the first rotation body 71 in the vertical direction shown in FIG. 8 may be equal to or less than the length L2 of the half cut tape 57 in the vertical direction. The length L4 of the second rotation body 72 in the vertical direction may be equal to or greater than the length L2 of the half cut tape 57 in the vertical direction. The diameter of the first rotation body 71 shown in FIG. 7 may be equal to or greater than the diameter of the second rotation body 72.

The first distance L5 may be greater than one third of the second distance L6. The position of the top end 851 of the extension wall portion 85 shown in FIG. 8 may be at the same position as the top end 715 of the first rotation body 71 or may be lower than the top end 715. The cassette case 31 shown in FIG. 2 need not be divided into the top case 311 and the bottom case 312. In the above-described embodiment, the plurality of bent portions 701 to 703, at which the feed path 59 shown in FIG. 7 is bent, all bend toward the head insertion portion 39. However, in addition to the bent portions 701 to 703, bent portions may be provided that bend in a direction away from the head insertion portion 39.

In the feed path 59 of the above-described embodiment, the locations that bend toward the head insertion portion 39 are only the three locations of the first rotation body 71, the second rotation body 72, and the guide portion 33. However, the locations in the feed path 59 that bend toward the head insertion portion 39 may be four or more locations. In the above-described embodiment, the recessed portion 84 is positioned on the second direction side of the second virtual line 732. However, the recessed portion 84 may be positioned on the second virtual line 732 or may be positioned on the third direction side of the second virtual line 732. The arm portion 34 need not necessarily be provided. The head insertion portion 39 need not necessarily be provided. The second regulating part 76 need not necessarily be provided. The distance L3 between the first rotation body 71 and the opening 80 may be shorter than the diameter of the first rotation body 71.

Figure 9:
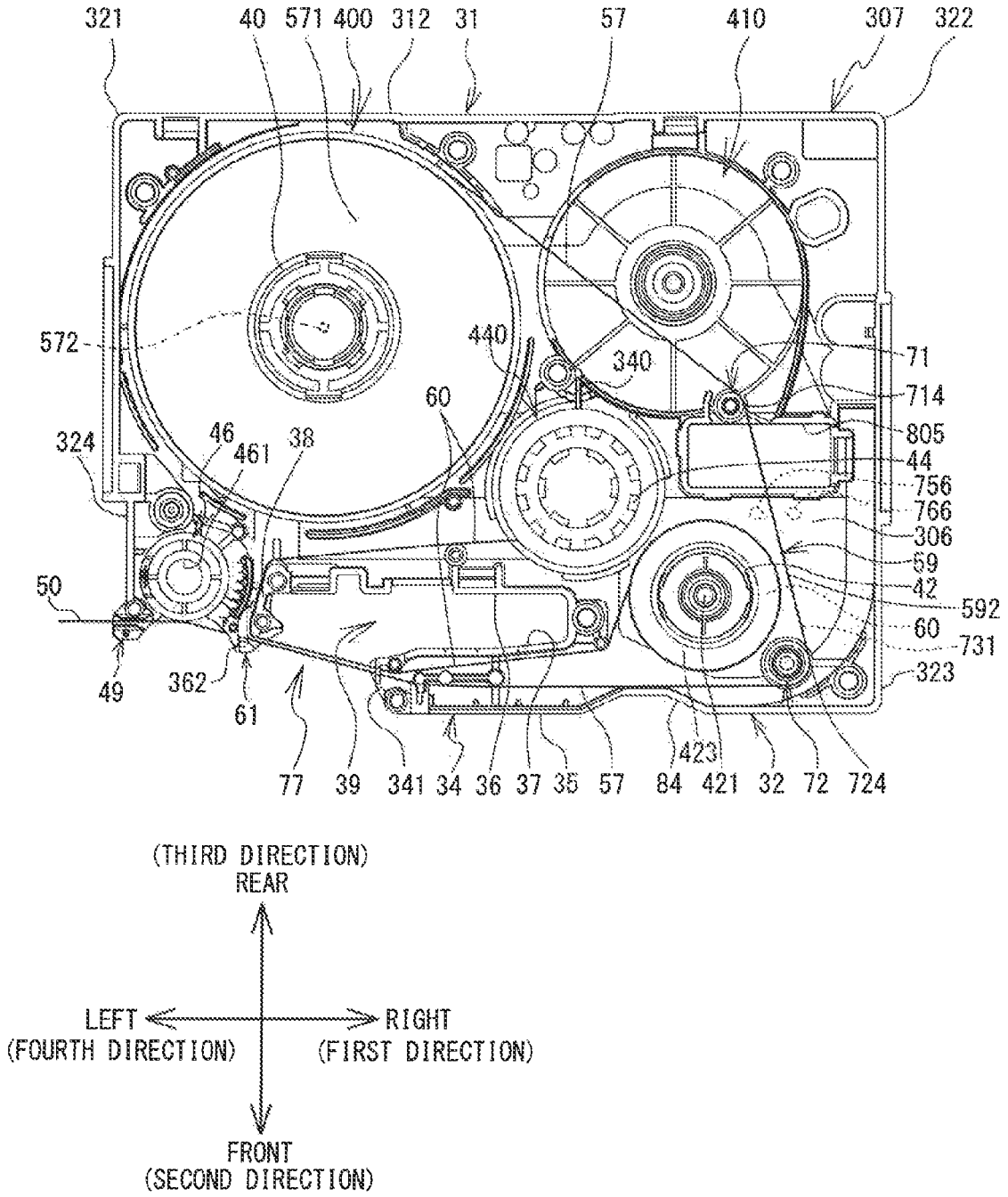
FIG. 9 is a plan view of a tape cassette according to a modified example, in a state in which the top case 311 is removed.

The first regulating part 75 need not necessarily include the wall portion 751 provided on the second direction side of the opening 801. The second regulating part 76 need not necessarily include the wall portion 761 provided on the second direction side of the opening 802. For example, as shown in FIG. 9, a first regulating part 756 and a second regulating part 766 to be described later may be provided on the second direction side of the opening 80 (an opening 805 to be described later shown in FIG. 9).

In the above-described embodiment, the tape housed in the first tape area 400 is the half cut tape 57, for example. However, the tape housed in the first tape area 400 need not necessarily be the half cut tape 57. For example, a print tape or the like may be disposed in the first tape area 400. Even when it is the print tape without the cuts 578 (refer to FIG. 5), there is a possibility that adhesive may attach to a print surface side. However, even if it is the print tape, the same effects as for the half cut tape 57 may be obtained, and the possibility may be reduced that the print tape is less easily fed due to the adhesive.

In the above-described embodiment, the opening 80 includes the opening 801 and the opening 802, but the present disclosure is not limited to this example. For example, as with the opening 805 of a tape cassette 307 shown in FIG. 9, a single opening that is long in the left-right direction may be provided. In the example shown in FIG. 9, a wall portion is not provided on the front end portion of the opening 805, and the first regulating part 75 and the second regulating part 76 shown in FIG. 7 are not provided. However, in the example shown in FIG. 9, the first regulating part 75 may be provided in a position corresponding to the wall portion 751 shown in FIG. 7. Further, the second regulating part 76 may be provided in a position corresponding to the wall portion 761 shown in FIG. 7. As a modified example of the first regulating part 75 and the second regulating part 76, the first regulating part 756 and the second regulating part 766 shown by dotted lines in FIG. 9 may be positioned on the second direction side of the opening 805. The first regulating part 756 and the second regulating part 766 are cylindrically shaped and extend upward from the bottom plate 306. The first regulating part 756 is provided on the fourth direction side of the second feed path 592 and on the fourth direction side of the first virtual line 731. The second regulating part 766 faces the first regulating part 756 in the left-right direction. The second regulating part 766 is provided facing the first regulating part 756 with the second feed path 592 sandwiched therebetween. The second regulating part 766 is positioned on the first direction side of the first virtual line 731.

Figure 10:
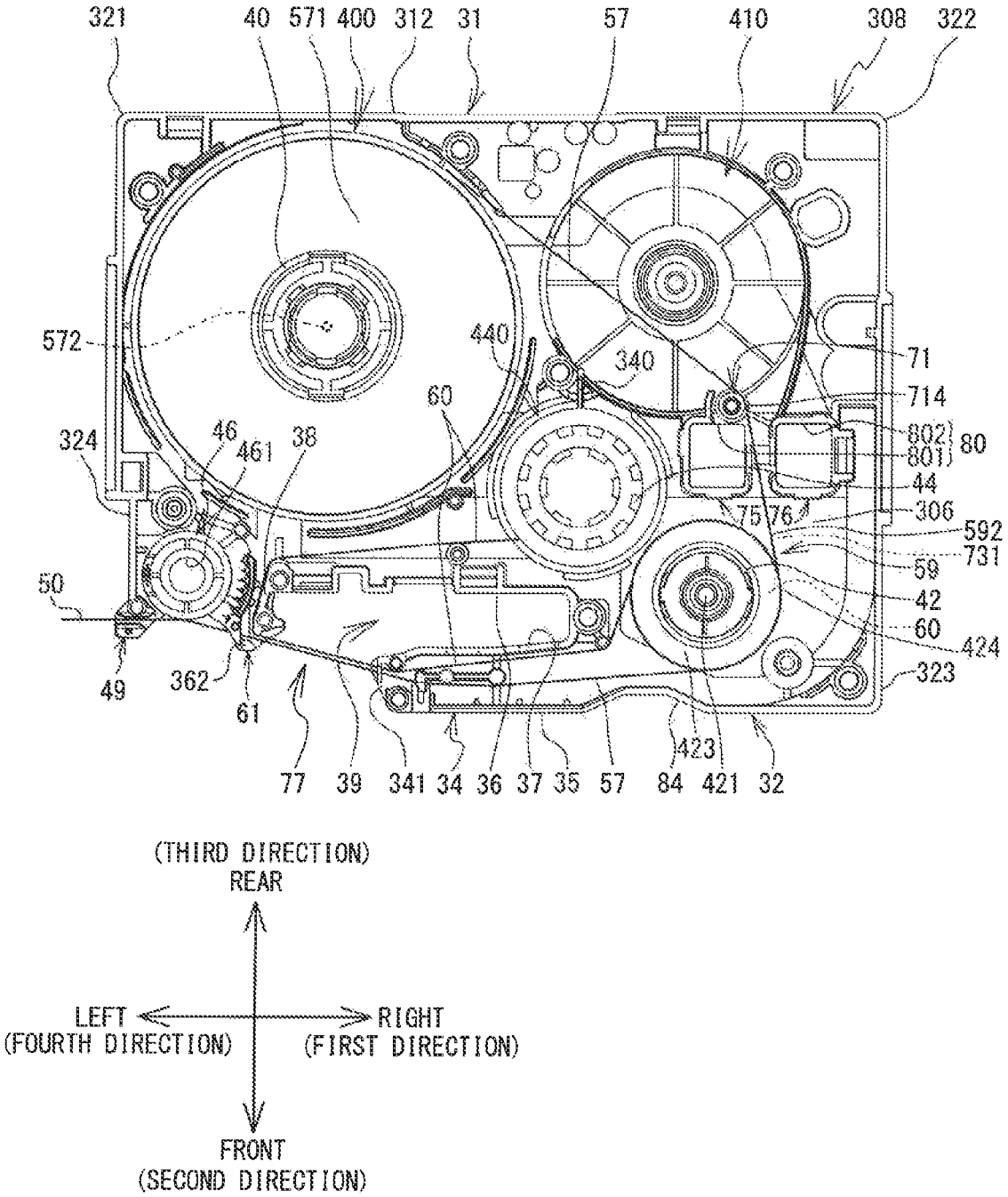
FIG. 10 is a plan view of a tape cassette according to a modified example, in a state in which the top case 311 is removed.

The second rotation body 72 need not necessarily be rotatably driven in accordance with the feeding of the half cut tape 57. For example, as with a tape cassette 308 shown in FIG. 10, the half cut tape 57 may be guided by the front right portion of the ribbon spool 42 and not by the second rotation body 72. The front right portion of the ribbon spool 42 that forms the feed path is provided on the first direction side and on the second direction side of the winding center 421 of the ink ribbon 60 on the ribbon spool 42. In the modified example shown in FIG. 10, a virtual line joining the end portion 714 on the first direction side of the first rotation body 71 and a front right portion 424 of the ribbon spool 42 is the first virtual line 731. Of the feed path 59, the feed path of the half cut tape 57 on the second direction side of the first rotation body 71 and on the third direction side of the front right portion of the ribbon spool 42 is the second feed path 592. The second feed path 592 and the first virtual line 731 are on the same line. The first regulating part 75 is provided on the fourth direction side of the second feed path 592 and on the fourth direction side of the first virtual line 731. The second regulating part 76 faces the first regulating part 75 in the left-right direction. The second regulating part 76 is provided facing the first regulating part 75 with the second feed path 592 sandwiched therebetween. The second regulating part 76 is positioned on the first direction side of the first virtual line 731.

Figure 11:
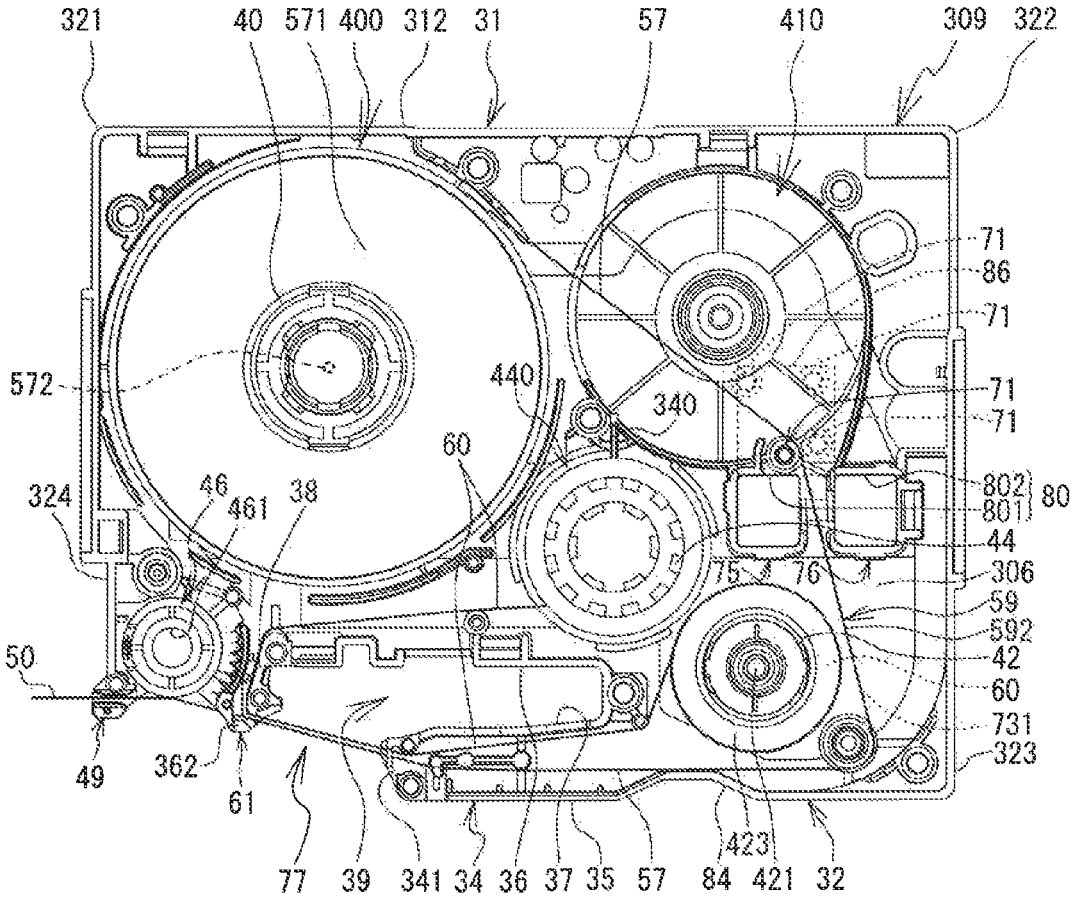
FIG. 11 is a plan view of a tape cassette according to a modified example, in a state in which the top case 311 is removed.
Figure 11:
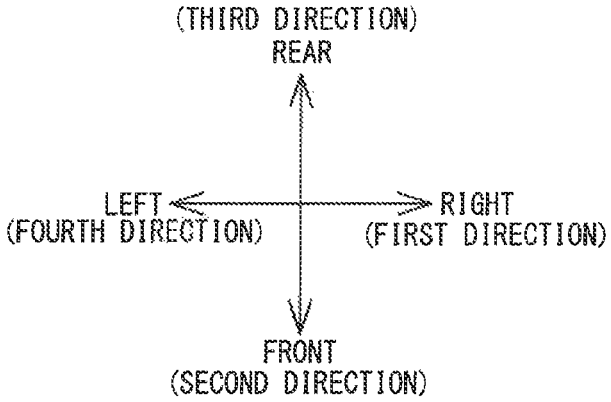

It is sufficient that the position of the first rotation body 71 be on the first direction side of the tape roll 571, on the second direction side of the winding center 572 of the tape roll 571, and on the third direction side of the opening 80. For example, as with a tape cassette 309 shown in FIG. 11, the first rotation body 71 may be provided inside an area 86. The area 86 is a rectangular area that is on the first direction side of the tape roll 571, on the second direction side of the winding center 572 of the tape roll 571, and on the third direction side of the opening 80. A position of the end portion of the area 86 in the fourth direction is at the same position, in the left-right direction, as the end portion of the opening 801 in the fourth direction. A position of the end portion of the area 86 in the first direction is at the same position, in the left-right direction, as the end portion of the opening 802 in the fourth direction. The first rotation body 71 may be provided in any position inside the area 86. In FIG. 11, as an example, cases are shown in which the first rotation body 71 is positioned in a front right portion, a rear right portion, and a rear left portion of the area 86. The position, in the left-right direction, of the end portion of the area 86 in the first direction may be at the same position as the end portion of the opening 802 in the first direction. Note that, as long as the first rotation body 71 is disposed inside the area 86, in comparison to a case in which the first rotation body 71 is disposed on the first direction side of the area 86, a bending angle bending in a direction away from the head insertion portion 39 becomes smaller at the second regulating part 76. Therefore, the possibility may be reduced that the half cut tape 57 is less easily fed.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A tape cassette having a front, a rear, a left side and a right side, the tape cassette comprising:

a cassette case having a bottom plate forming a bottom surface;

a tape roll housed inside the cassette case and on which is wound a tape that is a print medium;

a first rotation body positioned at a first direction from the tape roll and positioned at a second direction from a winding center of the tape roll, the first direction being the left side toward the right side, the second direction being the rear toward the front, the first rotation body forming a feed path of the tape and being configured to be driven to rotate in accordance with feeding of the tape;

a first opening positioned at the second direction from the first rotation body and penetrating the bottom plate in an orthogonal direction that is orthogonal to the bottom surface;

an ink ribbon roll positioned at the second direction from the first opening and on which is wound an ink ribbon to be used in printing of the tape;

a second rotation body positioned at the first direction from a winding center of the ink ribbon roll and positioned at the second direction from the winding center of the ink ribbon roll and forming the feed path; and a first regulating part that is a wall positioned at a fourth direction from a predetermined path, the predetermined path being a section of the feed path at the second direction from the first rotation body and at a third direction from the second rotation body, the third direction being an opposite direction to the second direction, the fourth direction being an opposite direction to the first direction, the first regulating part being positioned at the fourth direction from a first virtual line, the first virtual line being a virtual straight line joining an end portion of the first rotation body and an end portion of the second rotation body, the end portion of the first rotation body and the end portion of the second rotation body being a closest portion, respectively, of the first rotation body and the second rotation body to the right side, wherein the first opening includes two openings that are disposed side-by side and separate from each other, one of the two openings being positioned in the first direction with respect to the other of the two openings, the other of the two openings being aligned with the first rotation body in the second direction and the third direction and being at least partially aligned with the winding center of the ink ribbon roll in the second direction and the third direction.

2. The tape cassette according to claim 1, wherein a distance between the first rotation body and the first opening is shorter than a diameter of the first rotation body.

3. The tape cassette according to claim 1, further comprising a second regulating part that is a wall provided facing the first regulating part with the predetermined path therebetween and positioned at the first direction from the first virtual line.

4. The tape cassette according to claim 1, wherein the cassette case includes an end portion wall that is a wall portion at the front of the cassette, the tape cassette further comprises:

an arm portion including a part of the end portion wall of the cassette case, the arm portion extending in the first direction and the fourth direction along a section of the feed path that extends in parallel to the end portion wall, the arm portion having a discharge opening at at downstream end thereof, the discharge opening discharging the tape;

a guide portion that is a wall provided upstream with respect to the discharge opening and in the arm portion and guiding the tape to the discharge opening; and a second opening positioned at the third direction from the arm portion, the second opening penetrating the bottom plate in the orthogonal direction and being configured to extend across a central position of the cassette case in the first direction, and on the feed path along which the tape is discharged to the outside of the cassette case from the tape roll via the first rotation body, the second rotation body, the guide portion and the discharge opening, bent locations are only three locations of the first rotation body, the second rotation body and the guide portion, the bent locations being locations bending toward the second opening.

5. The tape cassette according to claim 1, wherein the cassette case includes an end portion wall that is a wall portion at the front of the cassette, the tape cassette further comprises:

an arm portion including a part of the end portion wall of the cassette case, the arm portion extending in the first direction and the fourth direction along a section of the feed path that extends in parallel to the end portion wall, the arm portion having a discharge opening at at downstream end thereof, the discharge opening discharging the tape;

a guide portion that is a wall provided upstream with respect to the discharge opening and in the arm portion and guiding the tape to the discharge opening; and a second opening positioned at the third direction from the arm portion, the second opening penetrating the bottom plate in the orthogonal direction and being configured to extend across a central position of the cassette case in the first direction, and on the feed path along which the tape is discharged to the outside of the cassette case from the tape roll via the first rotation body, the second rotation body, the guide portion and the discharge opening, a plurality of bent locations all bend toward the second opening, the feed path bending at the plurality of bent locations.

6. The tape cassette according to claim 4, further comprising a recessed portion provided in the end portion wall, the recessed portion being contiguous to an end portion of the arm portion, the recessed portion being between the right side of the cassette and the arm portion and being recessed in the third direction, wherein the recessed portion is positioned at the second direction from a second virtual line, the second virtual line joining an end portion of the guide portion and an end portion of the second rotation body.

7. The tape cassette according to claim 5, further comprising a recessed portion provided in the end portion wall, the recessed portion being contiguous to an end portion of the arm portion the recessed portion being between the right side of the cassette and the arm portion and being recessed in the third direction, wherein the recessed portion is positioned at the second direction from a second virtual line, the second virtual line joining an end portion of the guide portion and an end portion of the second rotation body.

8. The tape cassette according to claim 1, wherein the cassette case includes a top case having a top plate that forms a top surface of the cassette case and a bottom case having the bottom plate, and the bottom case includes an extension wall portion that extends from an end portion of the first opening in the third direction, the extension wall portion being positioned at the fourth direction from the first rotation body.

9. The tape cassette according to claim 8, wherein a distance between the top plate and a top end portion of the extension wall portion in the orthogonal direction is smaller than a distance between the top plate and a top end portion of the first rotation body in the orthogonal direction.

10. The tape cassette according to claim 2, wherein the first regulating part includes a wall portion provided on an end portion of the first opening, the end portion being closest to the front of the cassette, and a first distance is equal to or less than one third of a second distance, the first distance being a distance from an end portion of the first opening closest to the rear of the cassette to the wall portion in the third direction or the second direction, the second distance being a distance from the end portion of the first opening closest to the rear of the cassette to an end portion of the second rotation body closest to the front of the cassette in the third direction or the second direction.

11. The tape cassette according to claim 1, wherein the second rotation body is configured to be driven to rotate in accordance with the feeding of the tape.

12. The tape cassette according to claim 1, wherein a diameter of the first rotation body is shorter than a diameter of the second rotation body.

13. The tape cassette according to claim 1, wherein a length of the first rotation body in the orthogonal direction is longer than a length of the tape in the orthogonal direction, and a length of the second rotation body in the orthogonal direction is shorter than the length of the tape in the orthogonal direction.

14. The tape cassette according to claim 1, wherein the tape includes:

a print paper having a print surface used for printing and an adhesive surface, the adhesive surface being a surface of a layer of adhesive formed on the opposite side to the print surface;

a release paper adhered to the adhesive surface; and a cut formed in the print paper from the print surface to the adhesive surface, and the print surface is a surface which faces the left side of the cassette when the tape is between the first rotation body and the second rotation body.

* * * * *